US009627773B2

(12) United States Patent
Dewey et al.

(10) Patent No.: US 9,627,773 B2
(45) Date of Patent: Apr. 18, 2017

(54) STRUCTURE OF A PARABOLIC ANTENNA

(71) Applicant: Accton Technology Corporation, Hsin-Chu (TW)

(72) Inventors: Chad Elliot Dewey, Hsin-Chu (TW); Harold Riber Bledsoe, Hsin-Chu (TW)

(73) Assignee: Accton Technology Corporation, Hsin-Chu (TW)

( * ) Notice: Subject to any disclaimer, the term of this patent is extended or adjusted under 35 U.S.C. 154(b) by 36 days.

(21) Appl. No.: 14/753,027

(22) Filed: Jun. 29, 2015

(65) Prior Publication Data

US 2016/0294069 A1 Oct. 6, 2016

Related U.S. Application Data

(60) Provisional application No. 62/141,874, filed on Apr. 2, 2015.

(51) Int. Cl.

| | |
|---|---|
| ***H01Q 19/17*** | (2006.01) |
| ***H01Q 19/13*** | (2006.01) |
| ***H01Q 1/42*** | (2006.01) |
| ***H01Q 3/08*** | (2006.01) |
| ***H01Q 5/45*** | (2015.01) |

(52) U.S. Cl.

CPC ..... *H01Q 19/17* (2013.01); *H01Q 1/42* (2013.01); *H01Q 3/08* (2013.01); *H01Q 5/45* (2015.01); *H01Q 19/13* (2013.01)

(58) Field of Classification Search

CPC ..... H01Q 1/42; H01Q 1/421; H01Q 15/16; H01Q 19/13; H01Q 19/17; H01Q 5/45; H01Q 3/08

USPC ..... 343/840, 872, 853, 893, 711, 700 MS

See application file for complete search history.

(56) References Cited

U.S. PATENT DOCUMENTS

| | | | | |
|---|---|---|---|---|
| 4,090,203 | A | 5/1978 | Duncan | |
| 4,864,317 | A | 9/1989 | Sorko-Ram | |
| 5,815,125 | A * | 9/1998 | Kelly | H01Q 1/42 343/840 |
| 6,072,440 | A * | 6/2000 | Bowman | H01Q 1/42 343/840 |
| 6,580,401 | B1 * | 6/2003 | Gerhard | H01Q 21/061 343/853 |
| 6,714,167 | B1 * | 3/2004 | Gusick, Jr. | H01Q 1/42 343/872 |
| 7,187,334 | B2 * | 3/2007 | Franson | H01Q 1/3233 343/700 MS |
| 7,277,064 | B2 * | 10/2007 | Hogsett | H01Q 1/44 343/872 |
| 7,339,547 | B2 * | 3/2008 | Reid, Jr. | H01Q 1/42 343/840 |
| 8,552,918 | B2 * | 10/2013 | Lee | H01Q 9/285 343/702 |
| 2005/0083241 | A1 | 4/2005 | Zarro | |

(Continued)

*Primary Examiner* — Lam T Mai

(74) *Attorney, Agent, or Firm* — Winston Hsu; Scott Margo

(57) ABSTRACT

The parabolic antenna includes a first radiating element, a second radiating element and a parabolic dish. The operating frequency of the first radiating element is different from the operating frequency of the second radiating element. The first radiating element and the second radiating element are disposed in front of the parabolic dish. Under different circumstance, the first radiating element and the second radiating element may operate simultaneously or non-simultaneously.

21 Claims, 8 Drawing Sheets

(56) References Cited

U.S. PATENT DOCUMENTS

| | | | | |
|---|---|---|---|---|
| 2006/0125713 | A1* | 6/2006 | Thevenot | H01Q 5/00 343/909 |
| 2007/0115195 | A1 | 5/2007 | Locatori | |
| 2008/0238790 | A1 | 10/2008 | McGrath | |
| 2011/0079269 | A1* | 4/2011 | Vander Mey | F24J 2/10 136/246 |
| 2012/0176608 | A1* | 7/2012 | McCown | H01Q 15/16 356/138 |
| 2016/0211567 | A1* | 7/2016 | Tuau | H01Q 1/1242 |

* cited by examiner

STRUCTURE OF A PARABOLIC ANTENNA

CROSS REFERENCE TO RELATED APPLICATIONS

This non-provisional application claims priority to U.S. provisional application U.S. 62/141,874 filed on Apr. 2, 2015, and included herein by reference in its entirety.

BACKGROUND OF THE INVENTION

1. Field of the Invention

The present invention relates to a structure of a parabolic antenna, and more particularly, a structure of a parabolic antenna having radiating elements placed in front of a parabolic dish.

2. Description of the Prior Art

Wireless radio links are used to transmit data from one location to another. Wireless transmissions are frequently bidirectional. The wireless radio links utilize electromagnetic radiation of a specified frequency and data-encoding scheme. An antenna is used to transmit the electromagnetic radiation from one location to another location where it is received by another antenna and decoded for use at the second location. Typically, there is a line of sight path between the radio link antennas, so the path of the radio wave propagation is free from obstructions.

An antenna may not radiate in the same way in all directions. One class of antenna is designed to radiate strongly in one direction only. Radio link antennas are used to transmit data over large distances. Thus, it would be advantageous to be highly directional so that it causes fewer disturbances to other antennas.

Conventionally, antennas use waveguides to guide the electromagnetic radiation. There are different types of waveguides for each type of wave. The original and most common meaning for a waveguide is a hollow conductive metal pipe used to carry high frequency radio waves, particularly microwaves. Though waveguides may be used to guide the electromagnetic radiation to a desired direction, the production of waveguides is costly. Hence, there is a need to develop an antenna that would be able to uniformly propagate to desired direction without the use of waveguides.

SUMMARY OF THE INVENTION

A first embodiment of the present invention discloses a parabolic antenna. The parabolic antenna comprises a parabolic dish having a concave side, a first radiating element disposed on the concave side of the parabolic dish at a focal point of the parabolic dish, a second radiating element disposed on the focal point of the parabolic dish, and a housing configured to enclose the parabolic dish, the first radiating element, and the second radiating element.

A second embodiment of the present invention discloses a parabolic antenna. The parabolic antenna comprises a parabolic dish having a concave side, and a first radiating element and a second radiating element disposed on the concave side of the parabolic dish at a focal length of the parabolic dish. The concave side of the parabolic dish has a depth and a curvature.

A third embodiment of the present invention discloses a parabolic antenna. The parabolic antenna comprises a parabolic dish having a concave side, a first radiating element disposed in front of the concave side of the parabolic dish at a focal point of the parabolic dish and configured to operate a frequency, a second radiating element disposed at the focal point of the parabolic dish and configured to operate at a frequency lower than the frequency of the first radiating element, a processor coupled to the first radiating element using a Universal Serial Bus (USB) cable and the second radiating element using at least two coaxial cables and configured to control the operation of the first radiating element and the second radiating element according to an integrity of a signal of the first radiating element, and a housing configured to enclose the parabolic dish, the first radiating element, and the second radiating element.

A fourth embodiment of the present invention discloses a parabolic antenna. The parabolic antenna comprises a parabolic dish having a concave side and a radiating element of an antenna chipset disposed on the concave side of the parabolic dish at a focal point of the parabolic dish.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
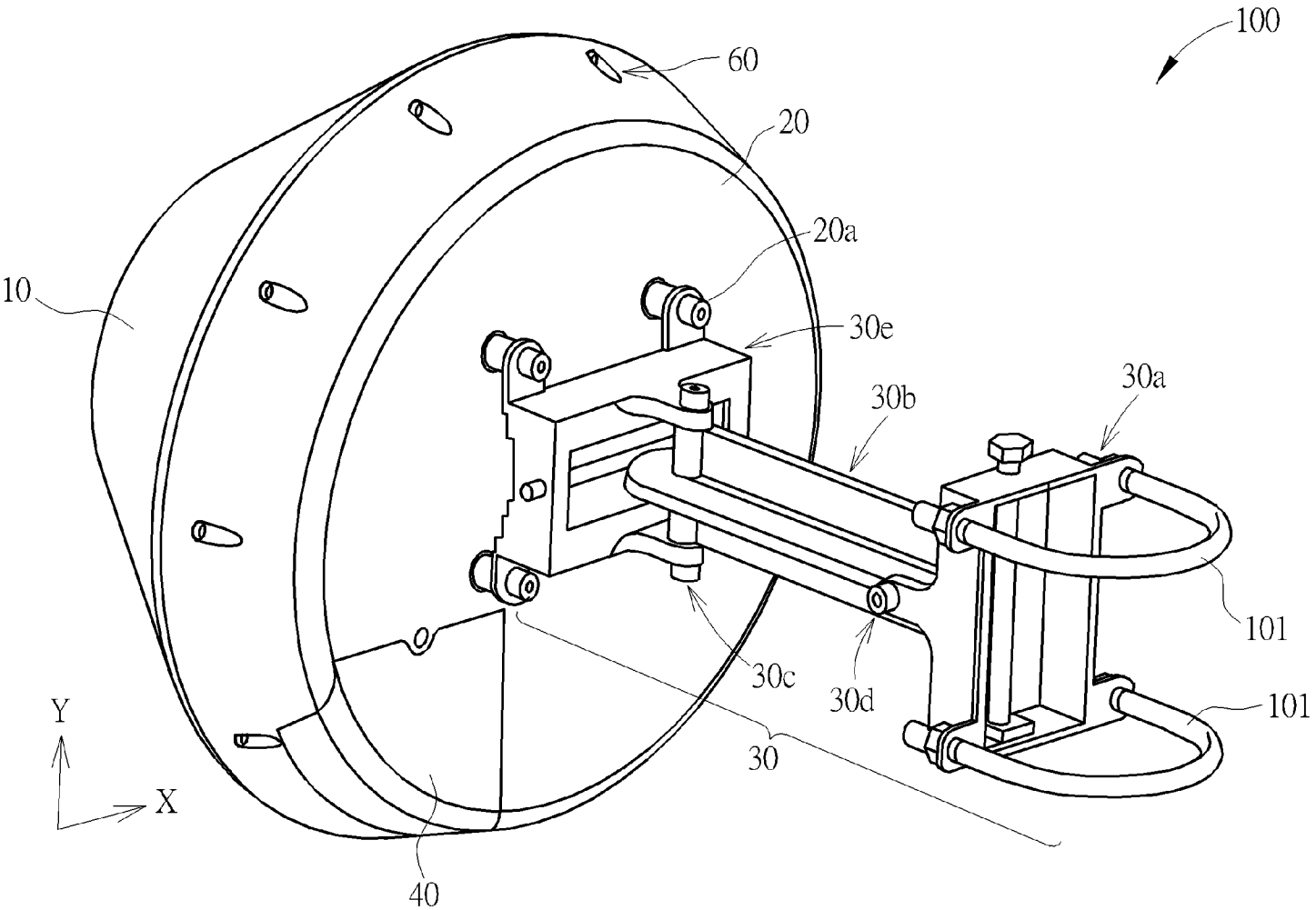
FIG. 1 illustrates a housing of a parabolic antenna according to an embodiment of the present invention.

FIG. 1 illustrates a housing 100 of a parabolic antenna according to an embodiment of the present invention. The housing 100 of the parabolic antenna shown in FIG. 1 comprises a radome 10, a backing 20 and an alignment bracket 30. The radome 10 may be a plastic radome and is a structural, weatherproof enclosure used to protect the parabolic antenna from the influence of outside environment. The radome 10 may be constructed using material that minimally attenuates signal transmitted or received by the parabolic antenna. The backing 20 may be coupled to the radome 10 using screws 60 for example. The backing 20 may further comprise screws 20*a* to couple the alignment bracket 30 to the parabolic antenna. The backing 20 may be a die cast backing.

The alignment bracket 30 comprises a first fixing mount 30*a*, an arm 30*b*, a first rotating joint 30*c*, a second rotating joint 30*d*, and a second fixing mount 30*e*. The first fixing mount 30*a* is used to mount the parabolic antenna to an external fixed structure using, for example, U-bolts 101. According to alternative embodiments, the parabolic antenna may be supported by any of a wide variety of known mounting apparatus and methods in conjunction with, or in place of, the first fixing mount 30*a* shown in FIG. 1. The first fixing mount 30*a* may in turn be mounted to other structures such as a radio tower or a building. The arm 30*b* is used to couple the first rotating joint 30*c* and the second rotating joint 30*d* to each other. The alignment bracket 30 may be coupled to the backing 20 by using the screws 20*a* to set the second fixing mount 30*e* onto the backing 20.

The first rotating joint 30*c* may be a type of bearing that couples the first fixing mount 30*a* to the arm 30*b* and allows the arm 30*b* to rotate at a range of angles corresponding to the first fixing mount 30*a*. In consequence, the parabolic antenna may be moved along a y-axis according to the rotation of the arm 30*b*.

The second rotating joint 30*d* may be a type of bearing that couples the arm 30*b* to the second fixing mount 30*e* and allows the second fixing mount 30*e* to rotate at a range of angles corresponding to the arm 30*b*. In consequence, the parabolic antenna may be moved along an x-axis according to the rotation of the second fixing mount 30*e*.

The first rotating joint 30*c* and the second rotating joint 30*d* may be used to adjust the positioning of the parabolic antenna for alignment with respect to a target, for example, another parabolic dish or any type of antenna used to transmit/receive signals. Furthermore, the first rotating joint 30*c* and the second rotating joint 30*d* may have corresponding set screws or other devices to hold the position of the parabolic antenna after positioning.

Figure 2:
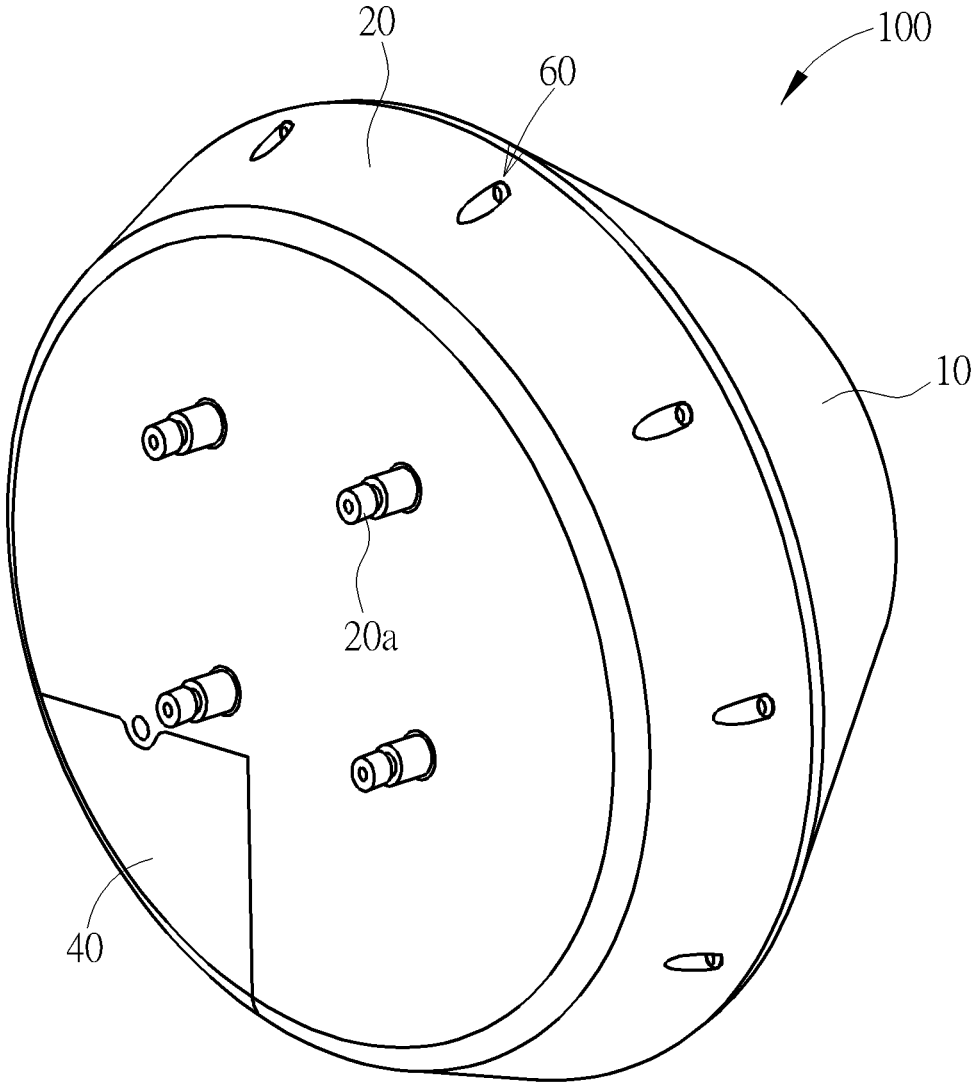
FIGS. 2 and 3 illustrate the housing of the parabolic antenna in FIG. 1 without the alignment bracket.
Figure 3:
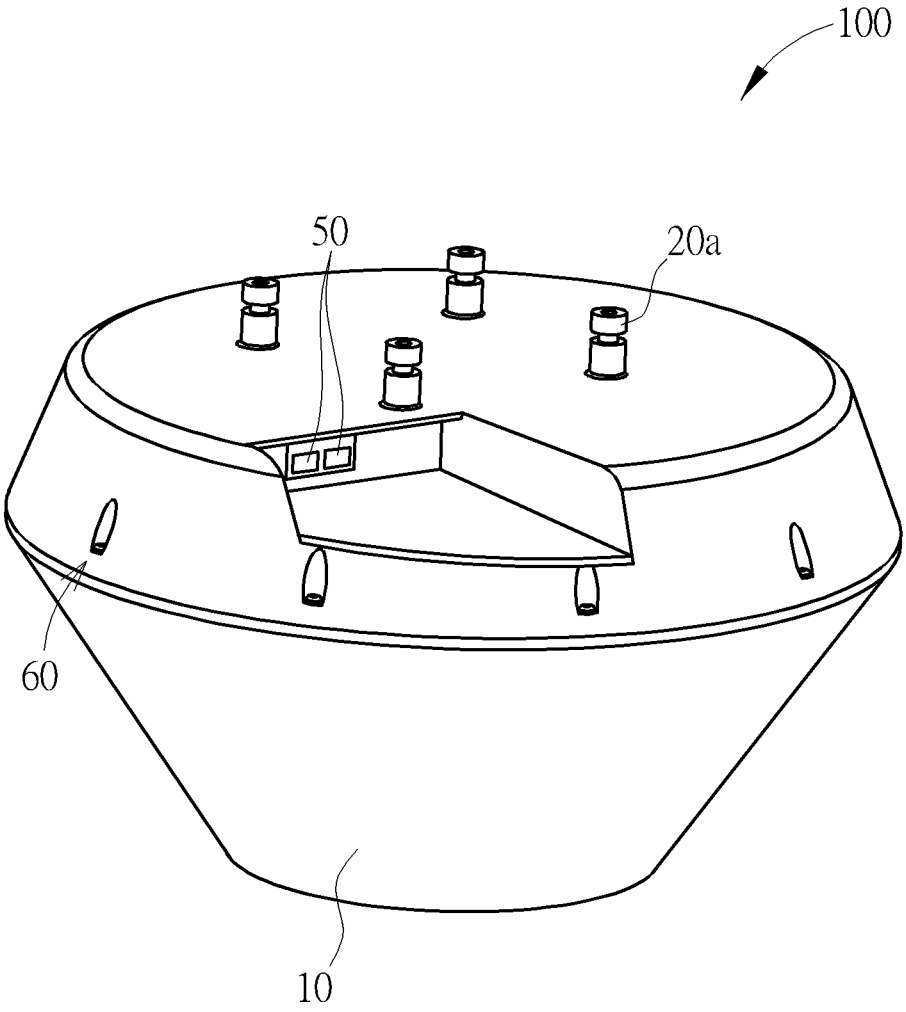

FIGS. 2 and 3 illustrate the housing 100 of the parabolic antenna in FIG. 1 without the alignment bracket. As shown in FIG. 2, a cover 40 may be coupled to the backing 20. The cover 40 may be used to protect connection ports 50 shown in FIG. 3 from the outside environment when not in use. The connection ports 50 may be a part of a processor or a controller 240 used to transmit or receive signal from an external electronic device. The processor or the controller may be used control or process signals received or transmitted by the parabolic antenna. The processor may also be used to determine the frequency of the signal received or transmitted by the parabolic antenna.

Figure 4:
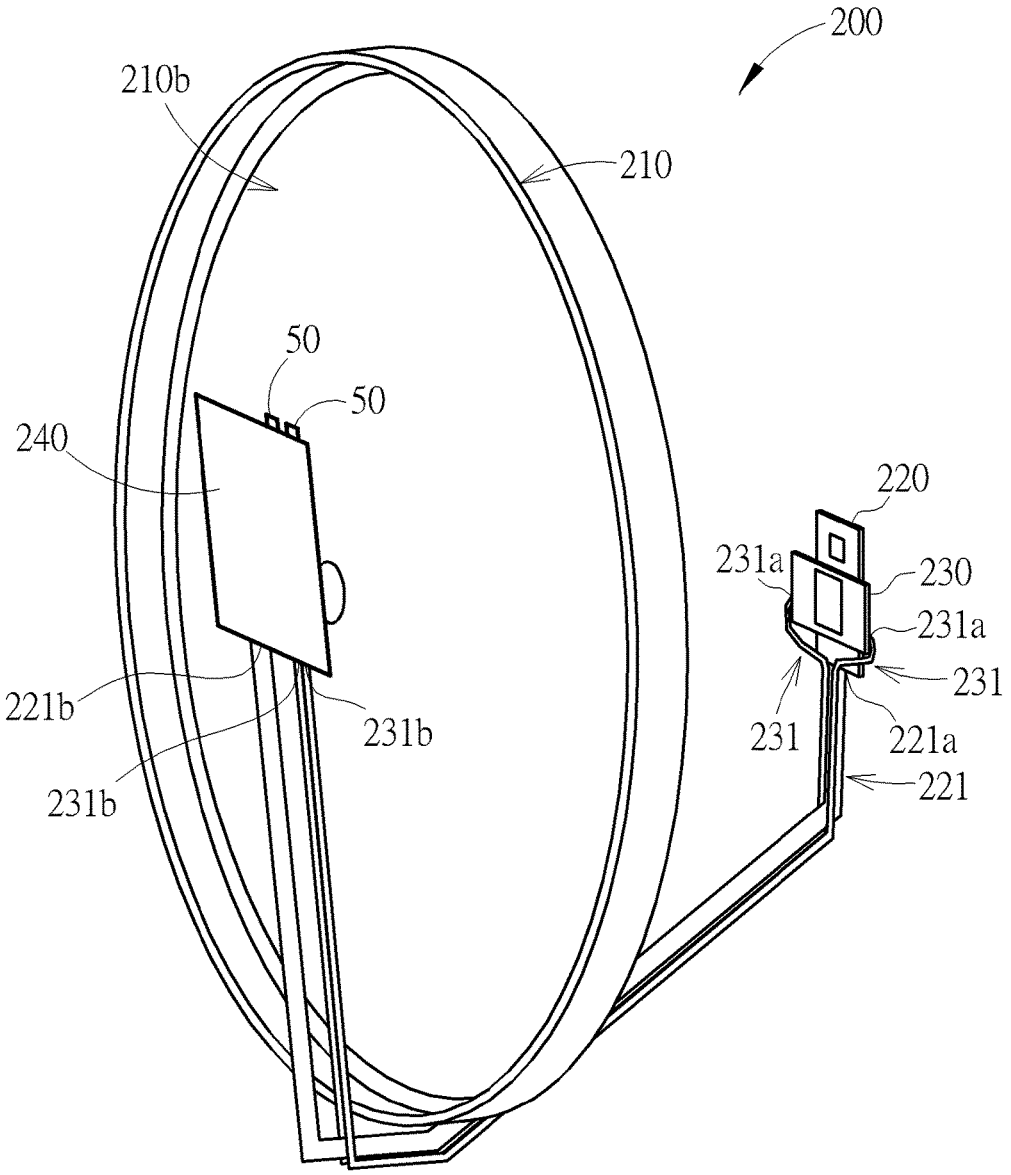
FIG. 4 illustrates the parabolic antenna enclosed in the housing of FIG. 1.

FIG. 4 illustrates the parabolic antenna 200 enclosed in the housing of FIG. 1. The parabolic antenna 200 comprises a parabolic dish 210, a first radiating element 220, and a second radiating element 230. The first radiating element 220 and the second radiating element 230 may be antennas operating using microwave frequencies having frequency range of 0.3 GHz to 300 GHz. The first radiating element 220 may be an antenna operating at higher frequency than the second radiating element 230 at a frequency range of 23 GHz to 90 GHz. As an example, the first radiating element 220 may be a 60 GHZ antenna. A USB cable 221 may be coupled to the first radiating element 220 to be able to digitally interface with the first radiating element 220. The other end of the USB cable 221 may be coupled to the processor. The second radiating element 230 may be operating at a frequency range of 2 GHz to 8 GHz. As an example, the second radiating element 230 may be a 5 GHz antenna. Coaxial cables 231 may be coupled to the second radiating element 230 to transfer signal to and from the second radiating element 230. An end 231*a* of a coaxial cable 231 may be coupled to one side of at least two sides of the second radiating element 230. And an end 231*a* of another coaxial cable 231 may be coupled to another side of at least two sides of the second radiating element 230. Another end 231*b* of the coaxial cables 231 may each be coupled to the processor.

The parabolic dish 210 has a convex side 210*b* and a concave side 210*a*. The convex side 210*b* may be the back of the parabolic dish 210 and is covered by the backing 20 of the housing 100 when enclosed. The processor may be disposed at the back of the parabolic dish 210. The concave side 210*a* may be the front of the parabolic dish 210 and is covered by the radome 10 of the housing 100 when enclosed.

The first radiating element 220 and the second radiating element 230 may be disposed directly at the focal point of the parabolic antenna. The radiating elements 220 and 230 may be positioned to be in perpendicular interlace to each other. The radiating elements 220 and 230 may be rectangular in shape. The radiating elements 220 and 230 may each have a first set of opposing edges having a first length and a second set of opposing edges having a second length. The second length of the radiating elements 220 and 230 may be greater than the first length. The first radiating element 220 and the second radiating element 230 may be positioned such that the opposing edges having first length of the first radiating element 220 are in parallel with the opposing edges having second length of the second radiating element 230. The second radiating element 230 may be disposed closer to the parabolic dish 210 relative to the first radiating element 220. The first radiating element 220 and the second radiating element 230 may or may not be of the same size.

The distance between the radiating elements 220 and 230 and the parabolic dish 210 may be far enough such that the radiating elements 220 and 230 may be able to uniformly radiate radio frequency (RF) waves from the radiating elements 220 and 230 on to the parabolic dish 210. The distance between the radiating elements 220 and 230 and the parabolic dish 210 may be far enough such that radio frequency (RF) waves received by the parabolic dish 210 may be focused towards the radiating elements 220 and 230 and be transmitted to the processor. The distance between the radiating elements 220 and 230 and the parabolic dish 210 may be the focal length of the parabolic dish 210. The first radiating element 220 may be an antenna having a corresponding antenna chipset. The antenna chipset may be a 60 GHz chipset and the connection ports 50 may be connection ports of the processor to control the radiating elements 220 and 230 of the parabolic antenna 200.

Furthermore, since the radiating elements 220 and 230 are placed in front of the parabolic dish 210, the parabolic antenna of the present invention does not need additional waveguides or directors. Thus, the cost of manufacturing the parabolic antenna is reduced. The radiating elements 220 and 230 may be fixed in front of the parabolic dish 210 using a support or by disposing the radiating elements 220 and 230 in the radome 10 in FIG. 1.

During the operation of the parabolic antenna, the first radiating element may have a gain amplified according to the requirement of the final application. The processor may be used to determine the signal strength of the first and second radiating elements. The first radiating element and the second radiating element may operate simultaneously or non-simultaneously. During bad weather, the signal of the first radiating element may be affected and may result in worsened transmission/reception. To avoid disturbance in transmission signals, the second radiating element operating at a different frequency may be used as a backup link. The processor may be used to control the switching of operation or simultaneous operation of the first radiating element and the second radiating element. The first radiating element and the second radiating element may share the same parabolic dish. The parabolic antenna may further comprise of an interface to control both the first radiating element and the second radiating element. Thereby, a simple and stable system for the parabolic antenna may be created.

In an embodiment, the processor may be used to determine the integrity of the signal of the first radiating element.

The integrity of the signal may comprise signal strength, signal to noise ratio, and delay of the signal. The integrity of the signal may be affected by outside environment of the parabolic antenna. The signal strength of the signal of the first radiating element may be compared to a predetermined threshold. When the signal strength of the first radiating element is less than the predetermined threshold, the operation of the first radiating element is switched to the second radiating element. In some other embodiments, delay in the transmission or reception of the signal of the first radiating element may be used to determine the switching of operation between the first radiating element and the second radiating element. The switching of operation between the first radiating element and the second radiating element may not cause any delay in the transmission or reception of the signal.

Figure 5:
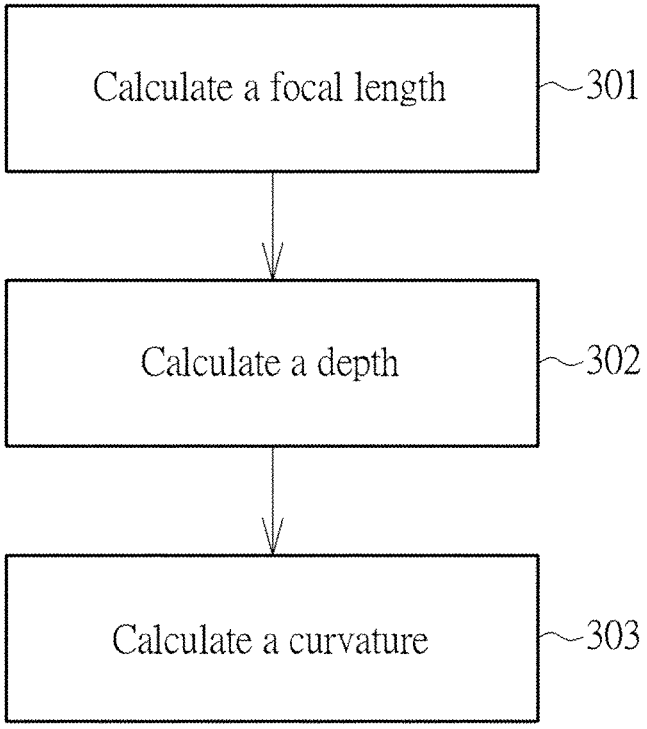
FIG. 5 illustrates a flowchart of a method for determining distance and measurements of the parabolic antenna according to an embodiment of the present invention.

FIG. 5 illustrates a flowchart of for a method for determining distance and measurements of the parabolic antenna according to an embodiment of the present invention. The method for determining distance and measurements of the parabolic antenna may include, but is not limited to, the following steps:

step 301: calculate a focal length of the parabolic dish;

step 302: calculate a depth of the parabolic dish according to the focal length; and step 303: calculate a curvature of the parabolic dish according to the focal length.

Figure 6:
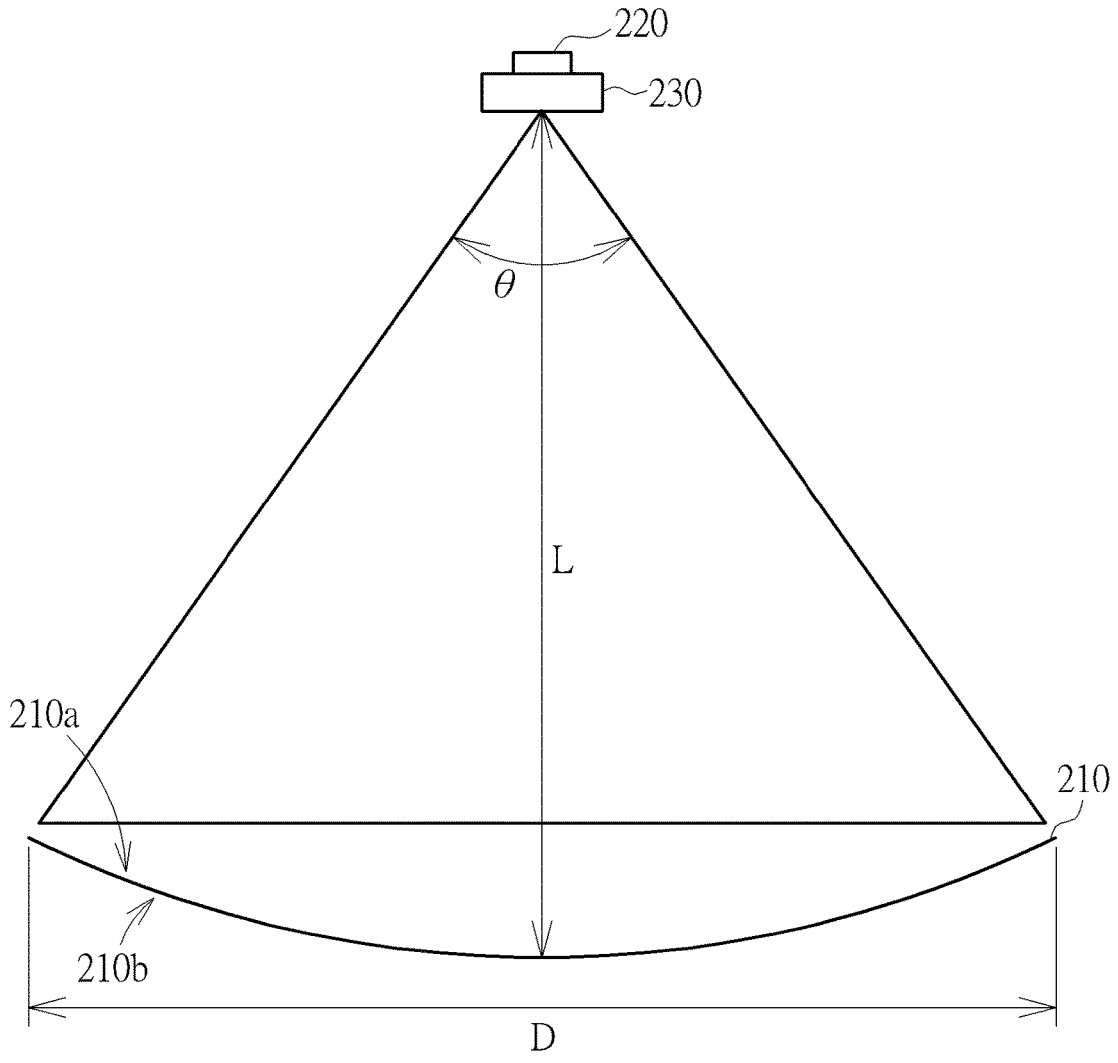
FIG. 6 illustrates a diagram of the parabolic antenna of FIG. 4 for calculating the focal length of the parabolic dish.

In step 301, the focal length of the parabolic dish may be calculated. The focal length is the distance between the vertex of the parabolic dish and the radiating elements. FIG. 6 illustrates a diagram of the parabolic antenna of FIG. 4 for calculating the focal length of the parabolic dish. The focal length may be calculated according to the following equation:

$$L = \frac{D}{2\left(\tan\left(\frac{\theta}{2}\right)\right)}$$

where:

L is the focal length of the parabolic dish;

D is the diameter of the parabolic dish; and

θ is the angle of the radiation pattern of the radiating elements.

Figure 7:
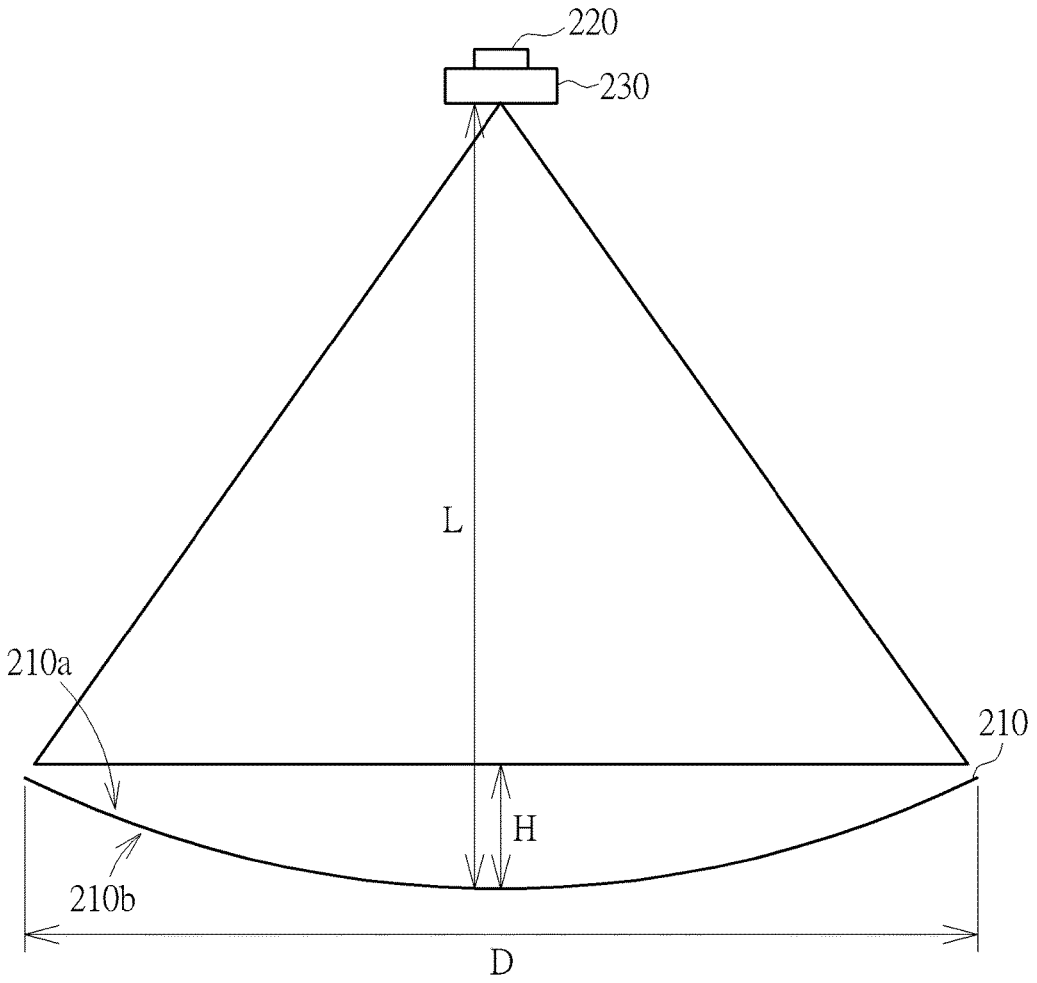
FIG. 7 illustrates a diagram of the parabolic antenna of FIG. 4 for calculating the depth of the parabolic dish.

In step 302, the depth of the parabolic dish may be calculated according to the focal length. The depth may be the height between the edge of the parabolic dish and the deepest point of the parabolic dish. FIG. 7 illustrates a diagram of the parabolic antenna of FIG. 4 for calculating the depth of the parabolic dish. The depth may be calculated according to the following equation:

$$H = \frac{D^2}{16\,\mathrm{L}}$$

where:

H is the depth of the parabolic dish;

L is the focal length of the parabolic dish; The focal length L of the parabolic dish may be the distance between the focal point of the parabolic dish and the deepest point of the concave side of the parabolic dish; and D is the diameter of the parabolic dish.

Figure 8:
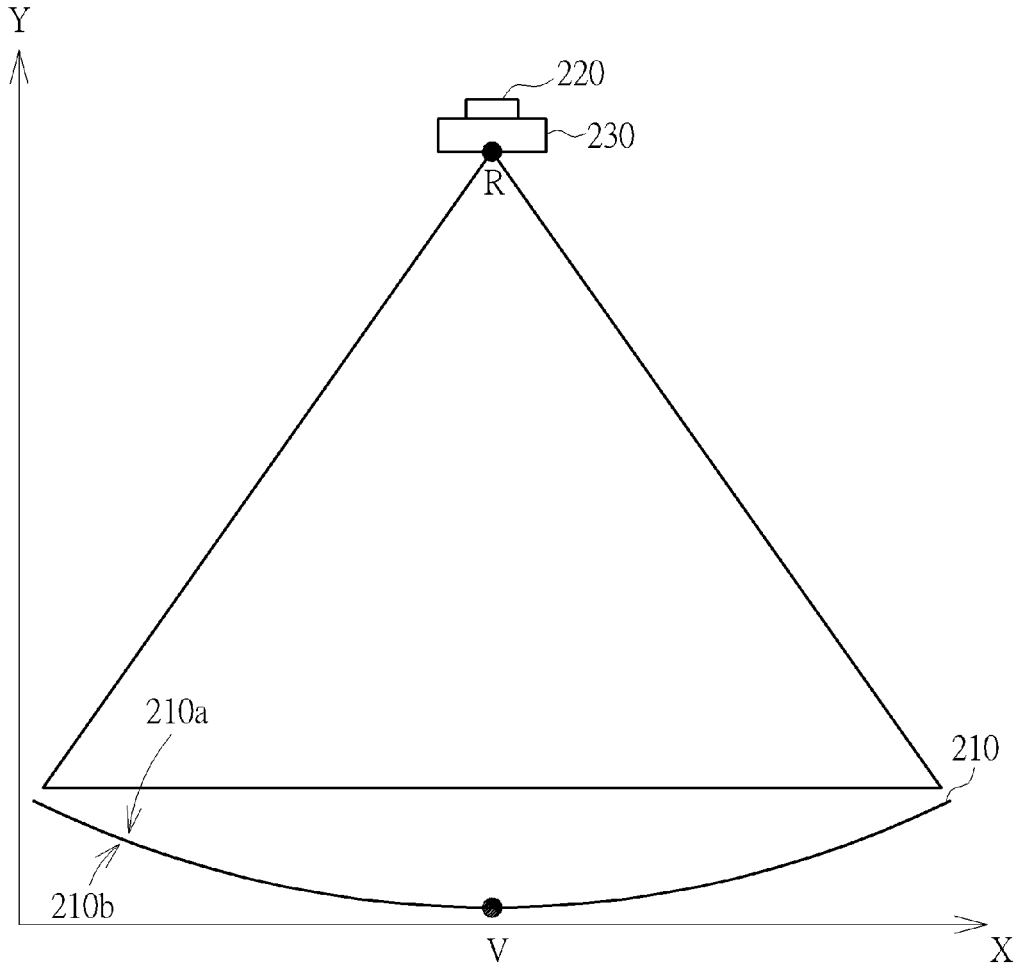
FIG. 8 illustrates a diagram of the parabolic antenna of FIG. 4 for calculating the depth of the parabolic dish.

In step 303, the curvature of the parabolic dish may be calculated according to the focal length. The curvature may be defined as the amount by which parabolic dish deviates from being flat. FIG. 8 illustrates a diagram of the parabolic antenna of FIG. 4 for calculating the depth of the parabolic dish. The curvature of the parabolic dish may be calculated according to the following equation:

$$C = \left(\frac{1}{4a}\right)X^2 - \left(\frac{V_x}{2a}\right)X + \left(V_y + \frac{V_x^2}{4a}\right)$$

where:

C is the curvature of the parabolic dish;

$V_x$ is the x-coordinate of the vertex of the parabolic dish;

$V_y$ is the y-coordinate of the vertex of the parabolic dish; and a is the distance from a vertex of the parabolic dish to the focal point of the parabolic dish and the vertex to the directrix of the parabolic dish.

The vertex V may be defined as the deepest point of the concave side of the parabolic dish. The vertex V may have a corresponding x-coordinate $V_x$ and y-coordinate $V_y$.

The distance from the vertex to the focal point and the vertex to the directrix may be calculated using the following equation:

$$a=\sqrt{(V_x-F_x)^2+(V_y-F_y)^2}$$

where:

a is the distance from the vertex to the focal point and the vertex to the directrix;

$V_x$ is the x-coordinate of the vertex of the parabolic dish;

$V_y$ is the y-coordinate of the vertex of the parabolic dish;

$F_x$ is the x-coordinate of the focal point of the parabolic dish; and $F_y$ is the y-coordinate of the focal point of the parabolic dish.

The vertex V may be defined as the deepest point of the concave side of the parabolic dish. The vertex V may have a corresponding x-coordinate $V_x$ and y-coordinate $V_y$.

According to an embodiment of the present invention, a parabolic antenna may comprise a radiating element and a parabolic dish. The radiating element may be an antenna of an antenna chipset that is commercially available. The antenna chipset may use a Universal Serial Bus (USB) to connect to other electronic devices. The antenna chipset may have operating frequency of 23 GHz to 90 GHz and may have operating range of 25 meters. To increase the operating range of the antenna chipset, the parabolic dish as shown in FIG. 4 may be used to amplify the gain of the radiating element of the antenna chipset. The operating range of the antenna chipset may be increased to, for example, 2 kilometers. The increase in the operating range may correspond to the diameter or the focal length of the parabolic dish. The radiating element may be disposed on the concave side of the parabolic dish at a distance equal to the focal length of the parabolic dish. The antenna chipset may be able to process the signal received or transmitted by the radiating element, thus, the parabolic antenna may not have a processor for processing signals. The antenna chipset may be directly coupled to an external electronic device using a USB cable. Furthermore, since the radiating element is placed in front of the parabolic dish, the parabolic antenna of the present invention does not need additional waveguides or directors.

The present invention presents an embodiment of a parabolic antenna having no waveguide or directors to reduce manufacturing cost. The parabolic antenna may comprise radiating elements operating under different frequency disposed at the focal point of the parabolic dish in front of the parabolic dish. The parabolic dish may be shared by the radiating elements. The radiating elements may operate under different conditions including working simultaneously during different data transmission or reception, working simultaneously during same data transmission or reception, and working non-simultaneously during data transmission or reception. Under bad weather conditions, the radiating element having higher operating frequency may be affected causing a decrease in the quality of the transmission link. Thus, use of the radiating element having higher operating frequency may be switched to the use another radiating element having lower operating frequency. For example, the radiating element having higher operating frequency may be a 60 GHz antenna and the other radiating element having lower operating frequency may be a 5 GHz antenna. The switching of the operation of the radiating elements may be done automatically using a processor or controlled by a user using an interface.

A further embodiment of a parabolic antenna may comprise a radiating element and a parabolic dish. The radiating element may be a part of an antenna chipset having a USB connector to connect to another electronic device. The antenna chipset may be used to process signals received and transmitted from the radiating element. The parabolic antenna may further comprise a housing to protect the parabolic antenna from outside environment. The radiating element may be disposed at the focal point of the concave side of the parabolic dish. Thus, there is no need for additional waveguides or directors.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A parabolic antenna, comprising:

a parabolic dish having a concave side;

a first radiating element disposed above the concave side of the parabolic dish at a focal point of the parabolic dish;

a second radiating element disposed at the focal point of the parabolic dish; and a housing configured to enclose the parabolic dish, the first radiating element, and the second radiating element;

wherein the first radiating element and the second radiating element uniformly radiate radio frequency (RF) waves to the parabolic dish.

2. The parabolic antenna of claim 1, wherein the housing configured to enclose the parabolic dish, the first radiating element, and the second radiating element comprises:

a radome;

a backing coupled to the radome; and an alignment bracket coupled to the backing.

3. The parabolic antenna of claim 2, wherein the alignment bracket comprises:

a first fixing mount configured to mount the parabolic antenna to a fixed structure;

a first rotating joint coupled to the first fixing mount and configured to rotate the parabolic antenna along a first direction;

an arm coupled to the first rotating joint;

a second rotating joint coupled to the arm and configured to rotate the parabolic antenna along another direction; and a second fixing mount coupled to the second rotating joint and configured to mount the parabolic antenna onto the alignment bracket.

4. The parabolic antenna of claim 1, wherein an operating frequency of the first radiating element is greater than an operating frequency of the second radiating element.

5. The parabolic antenna of claim 1, wherein the first radiating element and the second radiating element are positioned to be in perpendicular interlace to each other.

6. The parabolic antenna of claim 1, wherein the first radiating element and the second radiating element work simultaneously.

7. The parabolic antenna of claim 1, wherein the first radiating element and the second radiating element work non-simultaneously.

8. The parabolic antenna of claim 1, wherein operation of the first radiating element and the second radiating element are automatically controlled by a processor or controlled by a user using an interface.

9. A parabolic antenna, comprising:

a parabolic dish having a concave side;

a first radiating element and a second radiating element disposed on the concave side of the parabolic dish at a focal length of the parabolic dish; and a processor coupled to the first radiating element and the second radiating element using a Universal Serial Bus (USB) cable and at least two coaxial cables and configured to control the operation of the first radiating element and the second radiating element according to an integrity of a signal of the first radiating element;

wherein the concave side of the parabolic dish having a depth and a curvature.

10. The parabolic antenna of claim 9, wherein the focal length is calculated according to following equation:

$$L = \frac{D}{2\left(\tan\left(\frac{\theta}{2}\right)\right)}$$

where:

L is the focal length of the parabolic dish;

D is a diameter of the parabolic dish; and

θ is an angle of the radiation pattern of the radiating elements.

11. The parabolic antenna of claim 9, wherein the depth is calculated according to following equation:

$$H = \frac{D^2}{16\,\mathrm{L}}$$

where:

H is the depth of the parabolic dish;

L is the focal length of the parabolic dish; and

D is the diameter of the parabolic dish.

12. The parabolic antenna of claim 9, wherein the curvature is calculated according to the following equation:

$$C = \left(\frac{1}{4a}\right)X^2 - \left(\frac{V_x}{2a}\right)X + \left(V_y + \frac{V_x^2}{4a}\right)$$

where:

C is the curvature of the parabolic dish;

Vx is a x-coordinate of the vertex of the parabolic dish;

Vy is a y-coordinate of the vertex of the parabolic dish; and a is a distance from a vertex of the parabolic dish to a focal point of the parabolic dish and the vertex to a directrix of the parabolic dish.

13. The parabolic antenna of claim 12, wherein the distance from the vertex to the focal point and the vertex to the directrix is calculated according to the following equation:

$$a=\sqrt{(V_x-F_x)^2+(V_y-F_y)^2}$$

where:

a is the distance from the vertex to the focal point and the vertex to the directrix;

Vx is the x-coordinate of the vertex of the parabolic dish;

Vy is the y-coordinate of the vertex of the parabolic dish;

Fx is a x-coordinate of the focal point of the parabolic dish; and

Fy is a y-coordinate of the focal point of the parabolic dish.

14. A parabolic antenna, comprising:

a parabolic dish having a concave side;

a first radiating element disposed in front of the concave side of the parabolic dish at a focal point of the parabolic dish and configured to operate a frequency;

a second radiating element disposed at the focal point of the parabolic dish and configured to operate at a frequency lower than the frequency of the first radiating element;

a processor coupled to the first radiating element using a Universal Serial Bus (USB) cable and the second radiating element using at least two coaxial cables and configured to control the operation of the first radiating element and the second radiating element according to an integrity of a signal of the first radiating element; and a housing configured to enclose the parabolic dish, the first radiating element, and the second radiating element.

15. The parabolic antenna of claim 14, wherein operation of the first radiating element is switched to the second radiating element when a signal strength of the signal of the first radiating element is less than a predetermined threshold.

16. The parabolic antenna of claim 14, wherein operation of the first radiating element is switched to the second radiating element when the signal of the first radiating element experiences a delay.

17. A parabolic antenna, comprising:

a parabolic dish having a concave side; and a radiating element of an antenna chipset disposed on the concave side of the parabolic dish at a focal point of the parabolic dish;

wherein the radiating element uniformly radiates radio frequency (RF) waves to the parabolic dish.

18. The parabolic antenna of claim 17, further comprises:

a housing configured to enclose the parabolic dish and the radiating element.

19. The parabolic antenna of claim 18, wherein the housing configured to enclose the parabolic dish and the radiating element comprises:

a radome;

a backing coupled to the radome; and an alignment bracket coupled to the backing.

20. The parabolic antenna of claim 17, wherein an operating frequency of the radiating element ranges from 23 GHz to 90 GHz.

21. The parabolic antenna of claim 17, wherein the antenna chipset is configured to process transmitted or received signals from the radiating element.

* * * * *